US009211014B2

(12) United States Patent
Schmitz et al.

(10) Patent No.: US 9,211,014 B2
(45) Date of Patent: Dec. 15, 2015

(54) COMPOSITE BODY SUPPORT MEMBER AND METHODS FOR THE MANUFACTURE AND RECYCLING THEREOF

(71) Applicant: Herman Miller, Inc., Zeeland, MI (US)

(72) Inventors: Johann Burkhard Schmitz, Berlin (DE); Claudia Plikat, Berlin (DE); Carola E. M. Zwick, Berlin (DE); Roland R. O. Zwick, Berlin (DE); Andrew J Kurrasch, Saugatuck, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 13/705,870

(22) Filed: Dec. 5, 2012

(65) Prior Publication Data

US 2013/0147252 A1 Jun. 13, 2013

Related U.S. Application Data

(60) Provisional application No. 61/568,348, filed on Dec. 8, 2011.

(51) Int. Cl.

| | |
|---|---|
| ***A47C 7/02*** | (2006.01) |
| ***A47C 5/12*** | (2006.01) |
| ***A47C 7/16*** | (2006.01) |
| ***A47C 3/12*** | (2006.01) |
| ***A47C 7/40*** | (2006.01) |

(52) U.S. Cl.
CPC ... *A47C 5/12* (2013.01); *A47C 3/12* (2013.01); *A47C 7/16* (2013.01); *A47C 7/40* (2013.01)

(58) Field of Classification Search
CPC ..... A47C 5/12; A47C 7/16
USPC ..... 297/452.56
See application file for complete search history.

(56) References Cited

U.S. PATENT DOCUMENTS

| | | | |
|---|---|---|---|
| 2,124,634 | A | 7/1938 | Russell et al. |
| 3,133,765 | A | 5/1964 | Kramer |
| D201,355 | S | 6/1965 | Cavelli |

(Continued)

FOREIGN PATENT DOCUMENTS

| | | | |
|---|---|---|---|
| DE | 1282262 | A1 | 11/1968 |
| DE | 37 33 287 | A1 | 4/1989 |

(Continued)

OTHER PUBLICATIONS

International Search Report for International Application No. PCT/US2012/067849, dated Feb. 8, 2013, 1 page.

(Continued)

*Primary Examiner* — Kristina Junge
(74) *Attorney, Agent, or Firm* — Michael Best & Friedrich LLP

(57) ABSTRACT

A body support structure includes a molded polymeric support grid having a three-dimensional molded contour. The support grid includes a body support region having a plurality of through openings separated by a plurality of lands. In one embodiment, an area of the openings is greater than an area of the lands. In another embodiment, the ratio of a surface area of the lands relative to an area defined by an outer peripheral edge is less than or equal to 0.74. A fabric layer is bonded to the plurality of lands and covers the plurality of openings. Methods of manufacturing and recycling the body structure are also provided.

31 Claims, 6 Drawing Sheets

(56) References Cited

U.S. PATENT DOCUMENTS

| | | | | |
|---|---|---|---|---|
| 3,877,750 | A | 4/1975 | Scholpp | |
| 4,108,492 | A | 8/1978 | Kirby | |
| 4,189,180 | A | 2/1980 | Klein | |
| 4,216,184 | A | 8/1980 | Thomas | |
| 4,267,680 | A | 5/1981 | Delattre | |
| 4,339,488 | A | 7/1982 | Brokmann | |
| D273,728 | S | 5/1984 | Cafiero | |
| 4,451,085 | A | 5/1984 | Franck et al. | |
| 4,465,534 | A | 8/1984 | Zelkowitz | |
| 4,471,018 | A | 9/1984 | Kritchevsky et al. | |
| 4,474,840 | A | 10/1984 | Adams | |
| 4,529,246 | A | 7/1985 | Leib | |
| 4,556,254 | A | 12/1985 | Roberts | |
| 4,639,042 | A | 1/1987 | Lange | |
| 4,722,569 | A | 2/1988 | Morgenstern et al. | |
| 4,740,417 | A | 4/1988 | Tornero | |
| 4,915,448 | A | 4/1990 | Morgenstern et al. | |
| 5,003,649 | A | 4/1991 | Kelly | |
| 5,015,034 | A * | 5/1991 | Kindig et al. | 297/227 |
| 5,019,119 | A | 5/1991 | Hare, Sr. | |
| 5,034,173 | A | 7/1991 | Altman et al. | |
| 5,204,170 | A | 4/1993 | Kuyzin | |
| D346,279 | S | 4/1994 | Stumpf et al. | |
| D355,534 | S | 2/1995 | Saotome | |
| 5,456,976 | A | 10/1995 | LaMarca, II et al. | |
| 5,486,035 | A | 1/1996 | Koepke et al. | |
| 5,662,383 | A | 9/1997 | Hand | |
| 5,685,606 | A | 11/1997 | Lance | |
| 5,716,686 | A | 2/1998 | Black | |
| 5,797,652 | A | 8/1998 | Darbyshire | |
| 5,860,700 | A | 1/1999 | Lance | |
| 5,871,256 | A | 2/1999 | Kogai | |
| D407,570 | S | 4/1999 | Frauenberger | |
| 5,904,400 | A | 5/1999 | Wei | |
| 5,934,758 | A | 8/1999 | Ritch et al. | |
| 5,935,364 | A | 8/1999 | Groendal et al. | |
| 5,975,632 | A | 11/1999 | Ginat | |
| D417,792 | S | 12/1999 | Hansen et al. | |
| 6,024,712 | A | 2/2000 | Iglesias et al. | |
| D422,802 | S | 4/2000 | Deacon | |
| D423,259 | S | 4/2000 | Grove | |
| D423,260 | S | 4/2000 | Grove | |
| D424,824 | S | 5/2000 | Chu | |
| 6,062,649 | A | 5/2000 | Nagel et al. | |
| 6,099,076 | A | 8/2000 | Nagel et al. | |
| D431,400 | S | 10/2000 | Grove | |
| 6,127,012 | A | 10/2000 | Nagatsuna et al. | |
| 6,146,564 | A | 11/2000 | Beckmann | |
| D434,918 | S | 12/2000 | Arko et al. | |
| 6,165,404 | A | 12/2000 | Savonuzzi | |
| 6,179,384 | B1 | 1/2001 | DeKraker et al. | |
| D437,701 | S | 2/2001 | Bellini et al. | |
| 6,189,971 | B1 | 2/2001 | Witzig | |
| D440,419 | S | 4/2001 | Röder | |
| D442,790 | S | 5/2001 | Simons, Jr. et al. | |
| D442,791 | S | 5/2001 | Simons, Jr. et al. | |
| 6,241,930 | B1 | 6/2001 | Harrison | |
| D444,309 | S | 7/2001 | Nagamitsu | |
| D444,955 | S | 7/2001 | Su | |
| 6,254,186 | B1 | 7/2001 | Falzon | |
| D449,174 | S | 10/2001 | Neil | |
| D451,293 | S | 12/2001 | Su | |
| D453,079 | S | 1/2002 | Ma | |
| D456,159 | S | 4/2002 | Ball et al. | |
| D456,626 | S | 5/2002 | Su | |
| D456,650 | S | 5/2002 | Ball et al. | |
| D457,023 | S | 5/2002 | Ball et al. | |
| D457,739 | S | 5/2002 | Pearce et al. | |
| D461,323 | S | 8/2002 | Su | |
| 6,439,661 | B1 | 8/2002 | Bräuning | |
| 6,447,706 | B1 | 9/2002 | Savonuzzi | |
| 6,475,937 | B1 | 11/2002 | Preisler et al. | |
| D471,042 | S | 3/2003 | Schmitz et al. | |
| D471,370 | S | 3/2003 | Schmitz et al. | |
| 6,540,950 | B1 | 4/2003 | Coffield | |
| 6,564,400 | B2 | 5/2003 | Kelly et al. | |
| D476,821 | S | 7/2003 | Koepke et al. | |
| D477,151 | S | 7/2003 | Koepke et al. | |
| 6,590,364 | B2 | 7/2003 | Rogers, III et al. | |
| 6,604,302 | B2 | 8/2003 | Polegato Moretti | |
| D487,857 | S | 3/2004 | Brown | |
| D488,868 | S | 4/2004 | Lundrigan | |
| D490,994 | S | 6/2004 | Schmitz et al. | |
| 6,755,477 | B2 | 6/2004 | Chow | |
| D494,789 | S | 8/2004 | Brown | |
| D494,792 | S | 8/2004 | Schmitz et al. | |
| 6,880,886 | B2 | 4/2005 | Bodnar et al. | |
| 6,926,856 | B2 | 8/2005 | Hus et al. | |
| 6,932,430 | B2 | 8/2005 | Bedford et al. | |
| 6,969,114 | B2 | 11/2005 | Keilhauer | |
| 6,983,997 | B2 | 1/2006 | Wilkerson et al. | |
| 7,004,917 | B2 | 2/2006 | Henderson et al. | |
| 7,165,811 | B2 | 1/2007 | Bodnar et al. | |
| D536,557 | S | 2/2007 | Lee | |
| 7,226,130 | B2 | 6/2007 | Tubergen et al. | |
| 7,249,802 | B2 | 7/2007 | Schmitz et al. | |
| 7,264,311 | B2 | 9/2007 | Heidmann | |
| 7,311,686 | B1 | 12/2007 | Iglesias et al. | |
| 7,326,044 | B2 | 2/2008 | Kirchner | |
| 7,360,835 | B2 | 4/2008 | Tubergen et al. | |
| 7,396,500 | B2 | 7/2008 | Wani et al. | |
| 7,441,758 | B2 | 10/2008 | Coffield et al. | |
| D591,986 | S | 5/2009 | Schmitz et al. | |
| D594,681 | S | 6/2009 | Dauphin | |
| D597,772 | S | 8/2009 | True | |
| 7,637,570 | B2 | 12/2009 | Becker et al. | |
| D609,036 | S | 2/2010 | Miller et al. | |
| D612,642 | S | 3/2010 | Cassaday | |
| 7,670,306 | B2 | 3/2010 | Nordt, III et al. | |
| 7,794,022 | B2 | 9/2010 | Caruso et al. | |
| 7,841,666 | B2 * | 11/2010 | Schmitz et al. | 297/440.2 |
| 7,926,879 | B2 | 4/2011 | Schmitz et al. | |
| 7,992,936 | B2 | 8/2011 | Schmitz et al. | |
| 8,113,591 | B2 | 2/2012 | Cassaday | |
| 8,282,169 | B2 | 10/2012 | Schmitz et al. | |
| 2001/0042946 | A1 | 11/2001 | Schlieber et al. | |
| 2002/0195863 | A1 | 12/2002 | Su | |
| 2003/0001310 | A1 | 1/2003 | Masterson et al. | |
| 2003/0080595 | A1 | 5/2003 | Wilkerson et al. | |
| 2003/0168901 | A1 | 9/2003 | Wilkerson et al. | |
| 2004/0021348 | A1 | 2/2004 | Bourgeois et al. | |
| 2004/0145221 | A1 | 7/2004 | Suzuki | |
| 2004/0183350 | A1 * | 9/2004 | Schmitz et al. | 297/301.1 |
| 2004/0231941 | A1 | 11/2004 | Van Hoye et al. | |
| 2005/0012234 | A1 | 1/2005 | Kindig et al. | |
| 2005/0166317 | A1 | 8/2005 | Kelly | |
| 2005/0206210 | A1 | 9/2005 | Coffield | |
| 2005/0258678 | A1 | 11/2005 | Wilkerson et al. | |
| 2006/0006715 | A1 | 1/2006 | Chadwick et al. | |
| 2006/0022506 | A1 | 2/2006 | Chan | |
| 2006/0024473 | A1 | 2/2006 | Coffield | |
| 2006/0079144 | A1 | 4/2006 | Klisch et al. | |
| 2006/0138849 | A1 | 6/2006 | Wilkerson et al. | |
| 2006/0225666 | A1 | 10/2006 | Axelrod | |
| 2006/0275586 | A1 | 12/2006 | Hus et al. | |
| 2007/0035064 | A1 | 2/2007 | Coffield | |
| 2007/0102987 | A1 | 5/2007 | Chen | |
| 2007/0199797 | A1 | 8/2007 | Sell et al. | |
| 2008/0017304 | A1 | 1/2008 | Sell et al. | |
| 2008/0050551 | A1 | 2/2008 | Cleereman et al. | |
| 2008/0284229 | A1 | 11/2008 | Masunaga et al. | |
| 2008/0295950 | A1 | 12/2008 | Mack et al. | |
| 2009/0102268 | A1 | 4/2009 | Schmitz et al. | |
| 2009/0318843 | A1 | 12/2009 | Van Holten et al. | |
| 2010/0080980 | A1 | 4/2010 | Maheshwari et al. | |
| 2010/0117433 | A1 | 5/2010 | Cassaday | |
| 2010/0289308 | A1 | 11/2010 | Schmitz et al. | |

FOREIGN PATENT DOCUMENTS

| | | | |
|---|---|---|---|
| DE | 4132413 | A1 | 4/1993 |
| DE | 42 28 283 | A1 | 3/1994 |
| EP | 0004521 | A2 | 10/1979 |
| EP | 0049310 | A1 | 4/1982 |

(56) References Cited

FOREIGN PATENT DOCUMENTS

| | | | |
|---|---|---|---|
| EP | 0 475 198 | A2 | 3/1992 |
| EP | 0 517 615 | A1 | 12/1992 |
| EP | 1649999 | A2 | 4/2006 |
| EP | 1946676 | A1 | 7/2008 |
| EP | 2039271 | A1 | 3/2009 |
| EP | 2110050 | A1 | 10/2009 |
| JP | 57-029422 | A | 2/1982 |
| JP | 02-150321 | A | 6/1990 |
| JP | 11-090999 | A | 4/1999 |
| JP | 2001-078852 | A | 3/2001 |
| NL | 196701661 | A | 10/1967 |
| WO | WO 86/07528 | A1 | 12/1986 |
| WO | WO 93/25121 | A | 12/1993 |
| WO | WO 94/12334 | A1 | 6/1994 |
| WO | WO 96/09160 | A1 | 3/1996 |
| WO | WO 98/19879 | A1 | 5/1998 |
| WO | WO 99/38465 | A1 | 8/1999 |
| WO | WO 00/22961 | A1 | 4/2000 |
| WO | WO 00/74531 | A | 12/2000 |
| WO | WO 2004/011223 | A1 | 2/2004 |
| WO | WO 2004/023934 | A2 | 3/2004 |
| WO | WO 2004/107915 | A2 | 12/2004 |
| WO | WO 2007/058937 | A2 | 5/2007 |
| WO | WO 2007/100522 | A1 | 9/2007 |
| WO | WO 2007/110737 | A2 | 10/2007 |
| WO | WO 2010/071719 | A1 | 6/2010 |
| WO | WO 2011/157392 | A1 | 12/2011 |

OTHER PUBLICATIONS

Written Opinion of the International Searching Authority for International Application No. PCT/US2012/067849, dated Feb. 8, 2013, 6 pages.

Digital image of "Ypsilon" by Vitra, date unknown, but published prior to Jun. 7, 2013, 1 page.

Digital image of "Project 2000" by Sitag, date unknown, but published prior to Jun. 7, 2013, 1 page.

Digital image of "Fluid" by allseating, date unknown, but published prior to Jun. 7, 2013, 1 page.

Digital image of "HAG H05" by HAG, date unknown, but published prior to Jun. 7, 2013, 1 page.

Digital image of "Konca" by Kastel, date unknown, but published prior to Jun. 7, 2013, 1 page.

Digital image of "Vigor"/ Topdeq, date unknown, but published prior to Jun. 7, 2013, 1 page.

Digital image of "NetWeb"/Topdeq, date unknown, but published prior to Jun. 7, 2013, 1 page.

Digital image of "Lucy" by Vecta, date unknown, but published prior to Jun. 7, 2013, 1 page.

Digital image of "Open up"/Cairo, date unknown, but published prior to Jun. 7, 2013, 1 page.

Digital image of "IB Office" Seating by Bieffe, date unknown, but published prior to Jun. 7, 2013, 1 page.

Digital image of "Freedom" by Humanscale, date unknown, but published prior to Jun. 7, 2013, 1 page.

Digital image of "Cordo" by Klöber, date unknown, but published prior to Jun. 7, 2013, 1 page.

Digital images of "Please" by Steelcase, date unknown, but published prior to Jun. 7, 2013, 1 page.

Knoblauch, M. et al., "Umspritzen Schafft Den Durchbruch," Kunststoffberater (Plastic Advisor), vol. 40, Oct. 1999, pp. 40-41 (with English translation), 7 pages.

"X99 Haworth®" brochure, date unknown, but published prior to Jun. 7, 2013, 4 pages.

"Ypsilon vitra." brochure, date unknown, but published prior to Jun. 7, 2013, 27 pages.

Izzydesign "Maxwell" brochure, date unknown, but published prior to Jun. 7, 2013, 1 page.

* cited by examiner

FIG. 3
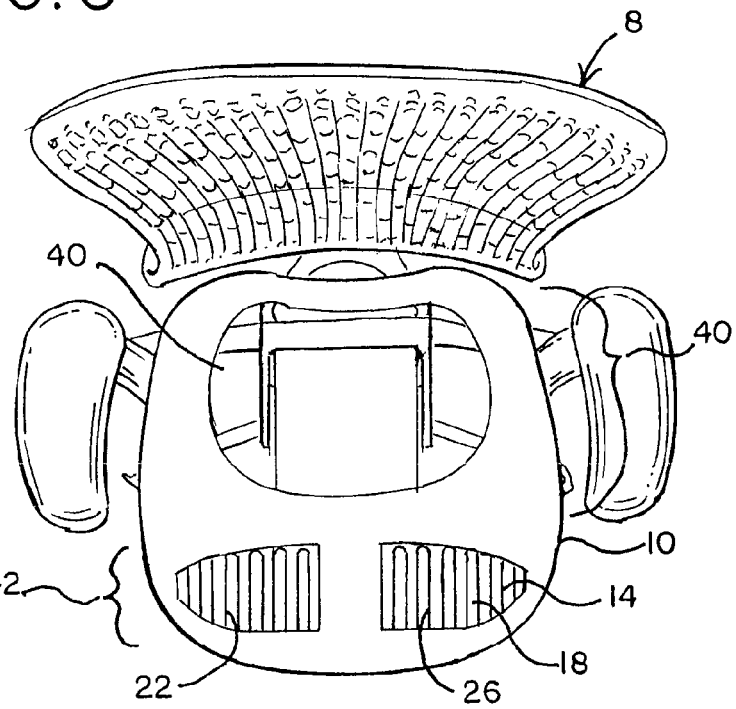
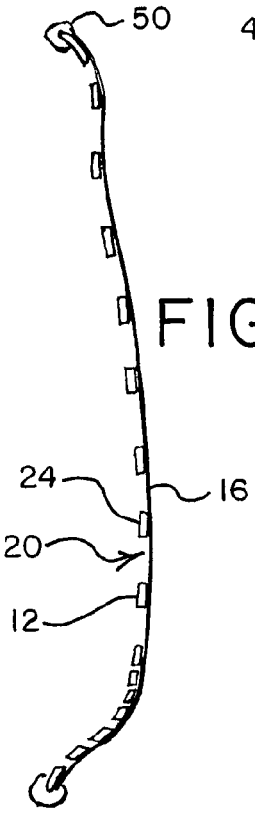
FIG. 4B
FIG. 4A
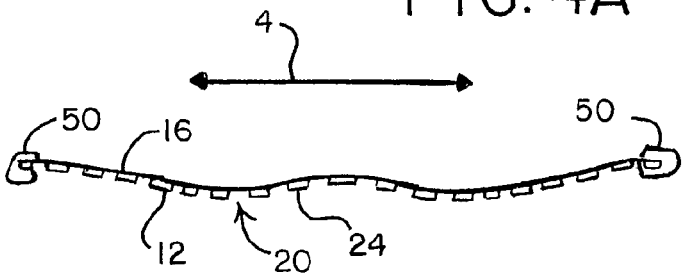

COMPOSITE BODY SUPPORT MEMBER AND METHODS FOR THE MANUFACTURE AND RECYCLING THEREOF

This application claims the benefit of U.S. Provisional Application No. 61/568,348, filed Dec. 8, 2011 and entitled Composite Body Support Member and Methods for the Manufacture and Use Thereof, the entire disclosure of which is hereby incorporated herein by reference.

FIELD OF THE INVENTION

The present invention relates generally to a body support member, such as a backrest or seat, and in particular, to a composite body support structure including a fabric layer and a polymer grid layer, and to methods for the manufacture and recycling thereof.

BACKGROUND

A variety of body support structures have been developed ranging from rigid fixed structures, for example wood or metal benches, to entirely fluid structures, such as hammocks. One type of body support structure is a membrane suspended over or between a frame, such as the backrest and seat embodied in the Aeron® chair developed by, and available from, Herman Miller, Inc., Zeeland Mich., the Assignee of the present application. The suspended membrane provides a high level of adaptivity and aeration, which are primary contributors to the comfort of the user. Typically, the deflection pattern for this type of suspension structure offers more flex in the middle of the support surface than at the edges, where the membrane is supported by the frame. It may be difficult to provide the body support surface with any contour, for example along any particular cross-section between frame members. In addition, the frame presents a relative rigid structure along the periphery of the support region.

Another type of body support structure is a molded polymer structure, such as the backrest embodied in the Mirra® chair developed by, and available from Herman Miller, Inc. Often, such structures are preshaped and frameless, with a three dimensional contour molded into the structure that conforms to the body of the user, thereby aiding in the distribution of the load applied by the user. The deflection capabilities of the structure may be predetermined by way of controlling a number of variables, including the material of the structure, the thickness thereof, the presence of holes, etc. While such structures may be covered with a fabric, the fabric typically is secured only around a peripheral portion of the molded back so as to not adversely affect the flexibility thereof. Such molded backs typically are less adaptive to applied loads than the suspended membrane structure described previously. At the same time, the molded component does not require a support frame, and may therefore be more adaptive at the periphery thereof.

SUMMARY

The present invention is defined by the following claims, and nothing in this section should be considered to be a limitation on those claims.

In one aspect, one embodiment of a body support structure includes a molded polymeric support grid having a three-dimensional molded contour. The support grid includes a body support region having a plurality of through openings separated by a plurality of lands. An area of the openings is greater than an area of the lands. A fabric layer is bonded to the plurality of lands and covers the plurality of openings.

In another aspect, one embodiment of the body support structure has a ratio N:M of a surface area of the lands to an overall area of a body support region defined by a peripheral edge that is less than or equal to 0.74, and in one embodiment less than or equal to 0.65.

In another aspect, one embodiment of the body support structure has a ratio Vl:Vm of a volume of land material (Vl) for the body support structure having openings to a volume of material (Vm) for the same body support structure having no openings that is less than or equal to about 0.74, and in one embodiment less than or equal to 0.65.

In yet another aspect, one embodiment of a method of manufacturing a body support structure includes molding a support grid in a three dimensional shape from a polymeric material and melting only a surface layer of the support grid while maintaining a solid substrate adjacent the molten surface layer. The method further includes pressing a fabric against the molten surface layer of the support grid. In one embodiment, the surface layer is melted using an infrared emitter. In another embodiment, an adhesive is applied to the surface of the support grid, and the adhesive is heated, for example by way of an infrared emitter or by conducting heat through the fabric as it is pressed against the adhesive.

In yet another aspect, a method of recycling a body support structure includes providing a fabric bonded to a molded polymeric support grid, wherein the fabric and the support grid are chemically miscible, and in embodiment are made of the same polymeric material. The method further includes melting the bonded fabric and the support grid and thereby forming a melted material, and collecting the melted material.

The various embodiments of the body support structure, and methods of manufacture thereof, provide significant advantages over other such structures and methods. For example and without limitation, the body support structure may be provided with a three-dimensional contour, but with increased adaptivity to the user. The composite structure is self-supporting, and does not require an integral frame structure to maintain the shape thereof, for example around a periphery thereof. The compounded materials may be selected and configured to provide various zones of greater flexibility. At the same time, the composite structure is temperature neutral, providing aeration, and provides the aesthetically desirable tactile qualities of fabric against the body of the user. The fabric provides soft transitions between the polymer grid, shields the user from contacting and feeling the grid, and allows for larger openings in the grid, due to the ability of the fabric to act in tension so as to hold the shape of the opening. This further provides adequate safeguards preventing the user, or others, from getting their fingers or other components stuck or pinched by the openings. The larger opening size in turn, provides for reduced material costs, greater flexibility of the structure, and greater flexibility in configuring the aesthetics. In one embodiment, the volume of material for the grid may be reduced by up to 40%.

The bonding process allows for the same types of materials to be used for the grid structure and fabric, without experiencing discoloration of bleeding of either the plastic or the fabric. At the same time, the bonds between the fabric and grid structure are sufficient to withstand the tensile forces applied to the fabric. Due to the same chemical make-up, the fabric and grid structure, in combination, may also be melted and collected for subsequent usage as a raw material for other manufacturing processes.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF THE DRAWINGS

FIG. 3 is a top, perspective view of the body support structure shown in FIG. 1.

FIGS. 4A and B are cross-sectional views of the body support structure shown in FIG. 1 taken along lines 4A-4A and 4B-4B.

DETAILED DESCRIPTION OF THE PRESENTLY PREFERRED EMBODIMENTS

Figure 1:
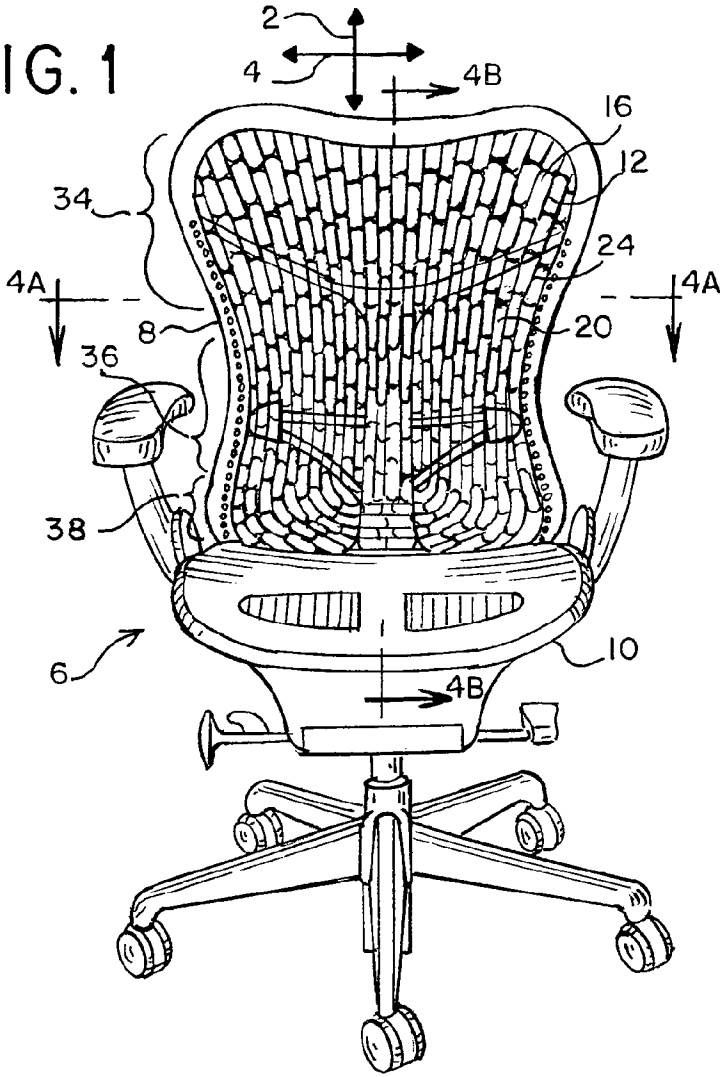
FIG. 1 is a front, perspective view of one embodiment of a body support structure.
Figure 5:
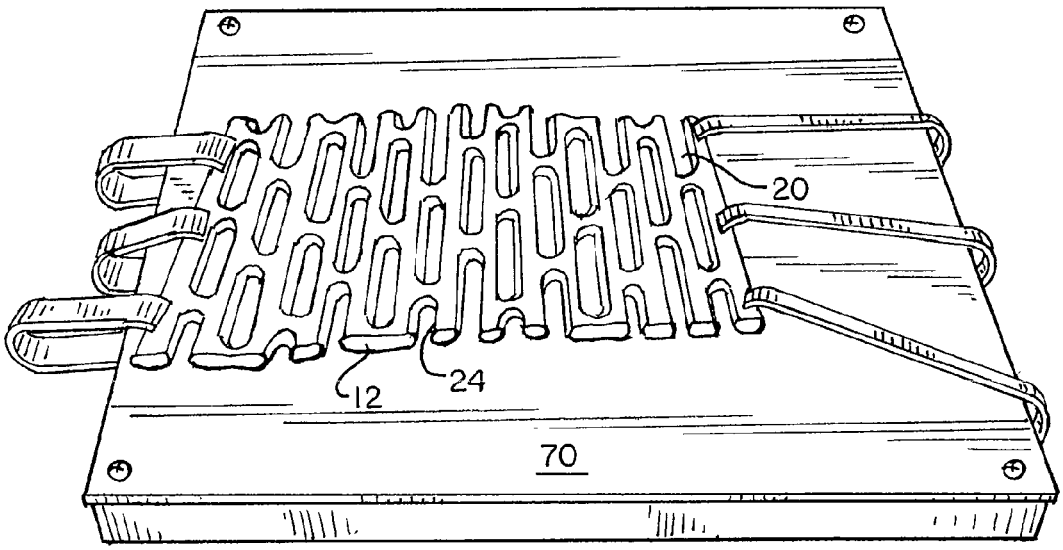
FIG. 5 is a perspective view of a molded support grid supported on a nest structure.
Figure 7:
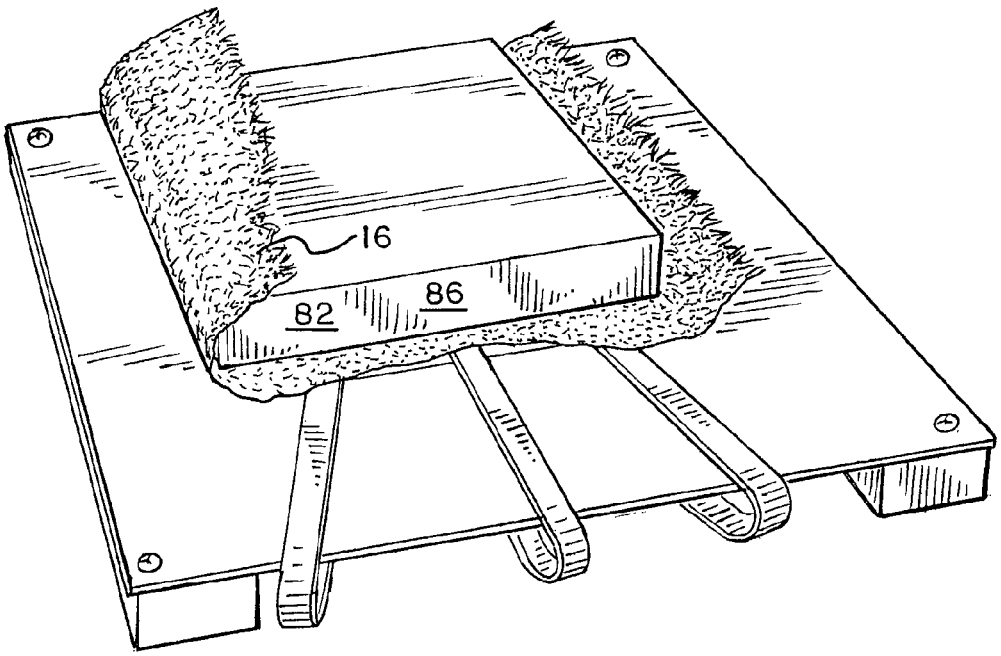
FIG. 7 is a perspective view of a fabric layer being pressed against a molded support grid having a molten surface layer.
Figure 6:
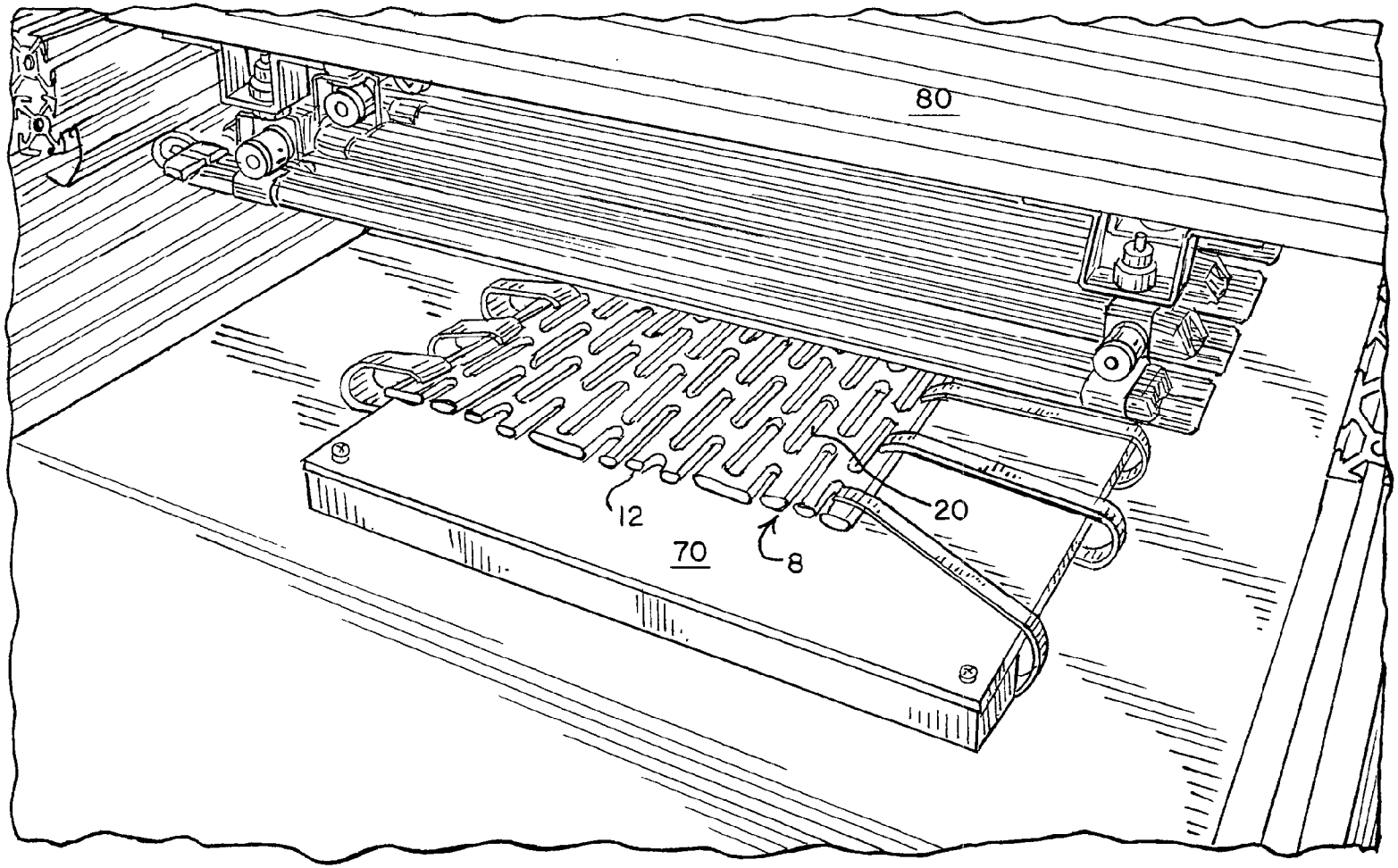
FIG. 6 is a perspective view of the molded support grid being exposed to infrared emissions.
Figure 9:
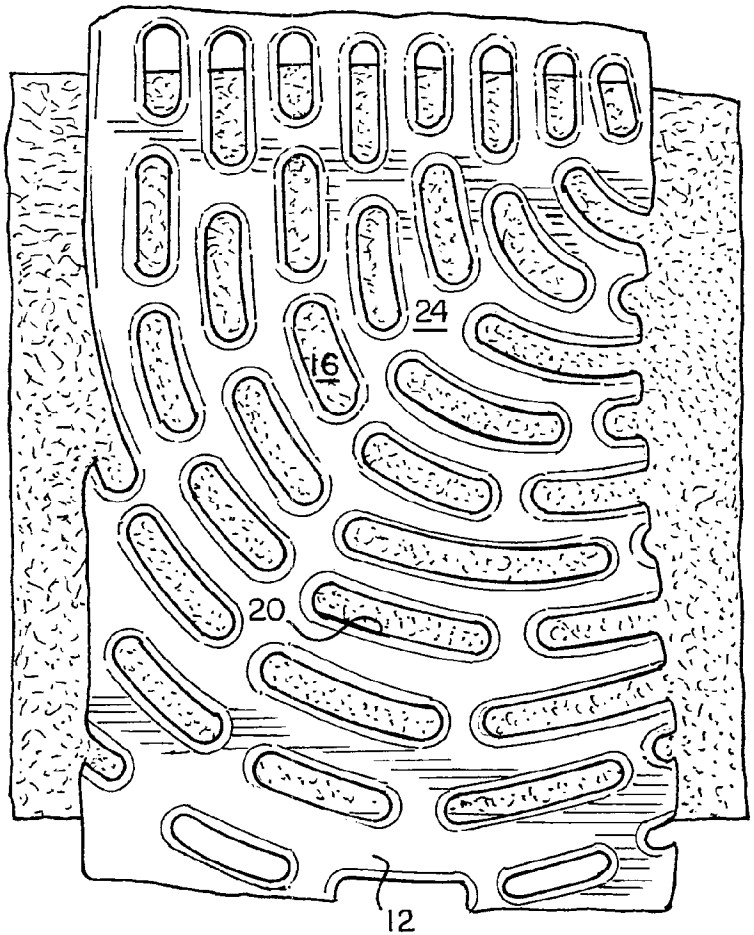
FIG. 9 is a bottom view of a molded support grid bonded to a fabric layer.
Figure 8:
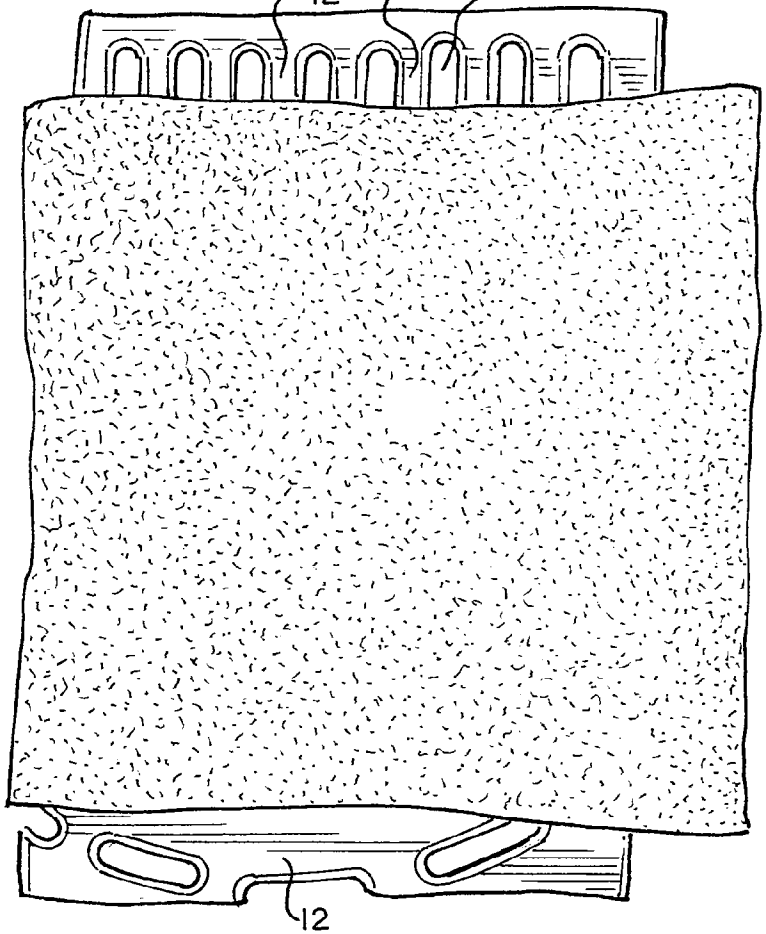
FIG. 8 is a top view of a fabric layer bonded to a molded support grid.

It should be understood that the term "plurality," as used herein, means two or more. The term "longitudinal," as used herein means of or relating to length or the lengthwise direction 2, as shown in FIG. 1. The term "lateral," as used herein, means directed between or toward (or perpendicular to) the sides of a body support structure, e.g., a lateral direction 4. The term "coupled" means connected to or engaged with, whether directly or indirectly, for example with an intervening member, and does not require the engagement to be fixed or permanent, although it may be fixed or permanent. The term "transverse" means extending across an axis or surface, including but not limited to substantially perpendicular to the axis or surface. It should be understood that the use of numerical terms "first," "second," "third," etc., as used herein does not refer to any particular sequence or order of components (e.g., consecutive); for example "first" and "second" support members may refer to any component members of a particular configuration unless otherwise specified.

Referring to FIGS. 1-4B, a body support structure 6, shown as an office chair, includes a backrest 8 and a seat 10. It should be understood that other body support structures may include without limitation automotive, airplane, mass transit, health care, educational, and auditorium seating, and/or variations thereof, as well as outdoor and home furnishings, including without limitation lounge chairs, sofas, and beds, and combinations thereof. Both the seat 10 and back 8 include a molded polymeric grid structure 14, 12 and an overlying fabric layer 18, 16. It should be understood that the term "fabric" refers to any thin, flexible material, whether woven, knitted, pressed, etc., wherein the material is not capable of independently maintaining a three dimensional contour. In various embodiments, the fabric may be made of polypropylene, which is extremely lightweight, moisture conducting (wicking), quick dry, capable of isolating heat/cold, stain release capable, resistant to abrasion, chlorine bleaching resistant and inexpensive, and has very good UV stability. Some suitable fabrics are available from Camira Fabrics, including for example the CITADEL fabric, which is 100% PERFENTEX (polypropylene), the CHATEAU PLUS fabric, made of 100% PERFENTEX PLUS (polypropylene with fire retardant salts ingrained in the fibers), and the ZETA fabric made of polyolefin.

The fabric layer 18, 16 overlies and covers various openings 22, 20 forming in the grid structure 14, 12. The fabric layer 18, 16 is connected, preferably by bonding, to lands 26, 24 defining and positioned between the openings 22, 20. The grid structure 14, 12 is formed with a predetermined three-dimensional contour, as shown for example in FIGS. 4A and 4B. The contour may be provided in both the lateral and longitudinal directions 4, 2. In one embodiment, the grid structure 14, 12 is made of a material from the same chemical family as the fabric layer 18, 16, for example polypropylene. In one embodiment, the grid structure and fabric layer are chemically compatible, and in one embodiment chemically miscible, which may facilitate recycling of the composite structure made up of the grid structure and fabric layer. Due to the connection between the lands 26, 24 and the fabric 18, 16, the openings 22, 20 in the grid structure may be made relatively large, both in width, diameter and/or length, as the fabric maintains the shape of the opening when the body support structure is loaded, for example by putting the fabric in tension. In one embodiment, the span of the opening, defined as the greatest of a width, length, diameter or other dimension of the opening, is greater or equal to 8 mm, and in one embodiment less than or equal to 25 mm, yet meets the British Standard BS EN 1335-2:2009 due to the fabric covering the openings and being connected to the lands. For example, as shown in the embodiment of FIG. 2, the openings 30 extend along substantially the entire length of the backrest, and for example from a thoracic region 34 to a sacral region 38, and are separated by lands 32.

Due to the connection of the fabric to the lands, shown as strips, the strips are prevented from spreading in both a lateral direction, as well as a fore-aft direction. Likewise, as show in FIG. 1, the openings 22, 20 are made relatively large, which provides improved aeration, but while maintaining a contoured shape and frameless structure. At the same time, the composite structure (grid structure and fabric layer) provides improved flexibility at desired locations. The flexibility of the structure may be further tuned by providing for different thickness of material of the lands 26, 24 at different location, or by modifying the size of the openings 22, 20. The fabric layer 18, 16 provides a pleasant tactile feel and softens the transition between the openings and lands of the grid structure, isolating that structure from direct contact with the user such that the edges do not create undesirable pressure points. At the same time, the composite structure feels temperature neutral to the user.

In one aspect, it is contemplated that the grid structure 14, 12, and in particular the lands 26, 24, act as veins of the grid structure (e.g., as in leaf), rather as a substrate with holes formed therethrough, with the fabric layer 18, 16 acting as the leaf material connecting the veins. The grid structure 14, 12, if not connected at the lands to the fabric, may not be capable of adequately supporting a user, but rather may be too flexible and flimsy. In this way, the fabric layer 18, 16 acts as a structural component that maintains the position of and the grid structure 14, 12 through tension while also supporting and interfacing with the body of the user. In this embodiment, the openings are the spaces formed between the veins. It should be understood that in some embodiments the "openings" are not necessarily closed on all sides, but may be bounded on only two sides.

Figure 2:
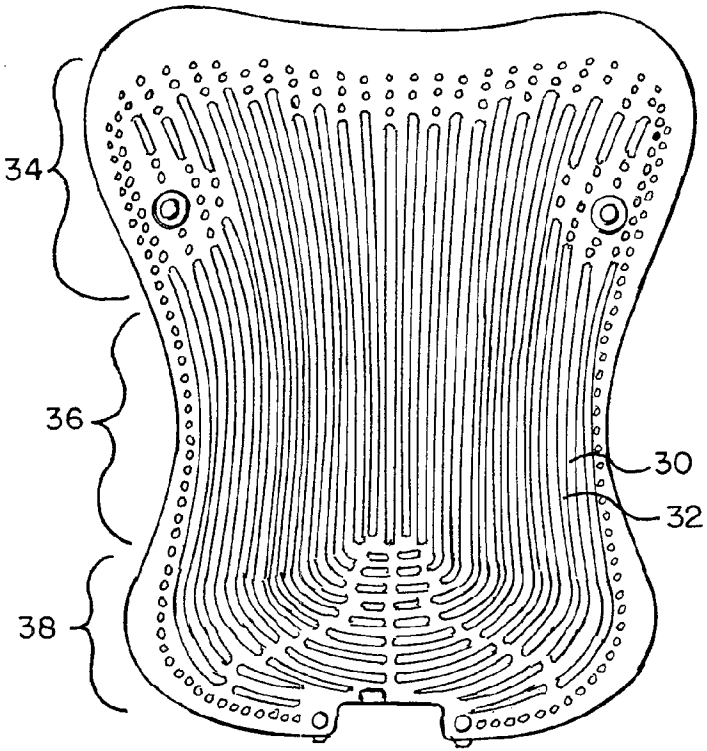
FIG. 2 is a front view of an alternative embodiment of a body support structure.

Referring to FIGS. 1 and 2, the body support structure 6, and in particular the backrest 8, includes various body support regions, for example a thoracic region 34, a lumbar region 36 and a sacral region 38. In one embodiment, openings 20, 30, or spaced apart lands 24, 32 (forming spaces 20, 30 therebetween), are formed at least in the thoracic region 34. In one embodiment, at least some of the plurality of openings 20, 30 are elongated, and may extend from the thoracic region to the lumbar region and even to the sacral region, or from the sacral region to the lumbar region. In another embodiment, a ratio (Vl:Vm) of a volume of land material (Vl(inches$^3$)) for the body support structure having openings to a volume of material (Vm(inches$^3$)) for the same body support structure having no openings that is less than or equal to about 0.74, in another embodiment less than or equal to 0.70 and in another embodiment less than or equal to 0.65. In one embodiment, the overall material volume of the grid structure is 32 inches$^3$, while the volume of a back without a bonded fabric layer and capable of supporting the same load is about 53 inches$^3$, thereby providing a ⅖ reduction in the polymeric material used to make the grid structure of the back. In yet another embodiment, the width of the openings is greater than the width of the lands therebetween, and in one embodiment the area of the openings is greater than the area of the lands disposed between the openings. In one embodiment, the body support structure has a ratio N:M of a surface area of the lands to an overall area of a body support region defined by a peripheral edge of the backrest 8 or seat 10 to that is less than or equal to 0.74, in another embodiment less than or equal to 0.70 and in another embodiment less than or equal to 0.65.

Referring to FIG. 3, the seat 10 is shown with the fabric layer 18 functioning as both a suspension material in one region 40 (e.g., buttock) of the seat, while the fabric layer is bonded to a grid structure 14 (land 26), thereby forming a contoured structure, in another region 42 (e.g., thigh). In the buttock region 40, the fabric is put in tension across a large opening, and is secured to a frame around the periphery of the opening, and functions as a suspension membrane.

Referring to FIG. 4, an edge detail 50 may be molded, or otherwise applied, around the periphery of the composite structure (grid structure and fabric layer) so as to obscure and cover the edge of the fabric.

Referring to FIGS. 4-10, during the assembly process, a grid structure 12 is molded in a predetermined three-dimensional contoured shape. The grid structure 12 is loaded onto a nest 70, which may be made of Aluminum. In one embodiment, the nest 70 may be configured with holes that match the holes in the grid structure 12, such that infrared radiation is not reflected from the nest to the backside of the grid structure. A piece of fabric 16, of sufficient area to cover the grid structure 12, or a predetermined portion thereof, is loaded into a press casset 82. The nest 70 is transported under an array of infrared emitters 80, or the array is moved over the nest. In one embodiment, the array 80 includes a plurality of 2200 watt infrared emitters located about 3 inches from the surface of the grid structure 12. The array 80 is turned on for a predetermined period of time, for example 15 seconds, which melts a surface layer 62 of the grid structure 12, while maintaining a lower layer 60 or substrate in solid (unmelted) form beneath and adjacent to the molten layer. The array may be turned on in sequence for even melting of the surface as the nest travels under the array. The nest 70 is then moved to a press station 86 (e.g., a bladder press), or the press station 86 is moved over/next to the nest 70, with the casset 82 moving under the press. The press 86 is actuated and presses the fabric layer 16 against the molten surface 62 of the grid structure 12 for a predetermined time (e.g., 16 seconds) at a predetermined load (e.g., 3 psi) such that the fabric 16 is bonded to the lands 24 of the support grid. The nest 70 then moves to a trim station, or a knife is moved over the nest, whereinafter a hot knife 90, or other cutting device including lasers, ultrasonic knifes, water jets, etc., is used to trim the fabric layer 16 flush with the edge of the grid structure 12, or relative to a portion of the grid structure. The trimmed part is then placed in an injection mold 94, with a trim edge 50 molded over the trimmed edge of the fabric, for example around the periphery of the grid structure. The nest may be moved automatically from one station to another under power, manually by hand, or some combination thereof.

Figure 10:
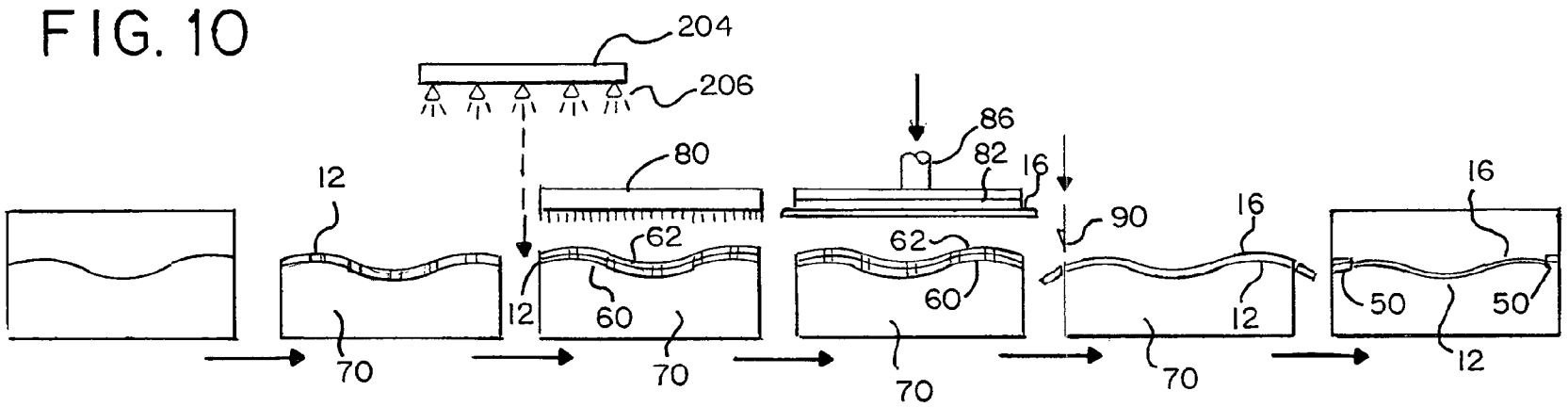
FIG. 10 is a schematic showing the process for molding a support grid and bonding a fabric layer thereto.

In an alternative embodiment, also referring to FIG. 10, the grid structure is heated to the melting point of a granulated hot melt adhesive 206, which adhesive is scattered onto the heated surface of the grid structure with an adhesive applicator 204. The adhesive 206 bonds to the grid structure, or falls through the openings 20. In one embodiment, the adhesive is reheated with an infrared emitter array 80 with the fabric layer 12 applied and the finishing operations performed as previously described. Alternatively, heat may be conducted through the fabric layer 16 to the adhesive 206 by way of a heated bladder press 86, with the fabric layer 16 being pressed against the adhesive and grid structure. Further finishing operations may then be performed as previously described.

Figure 11:
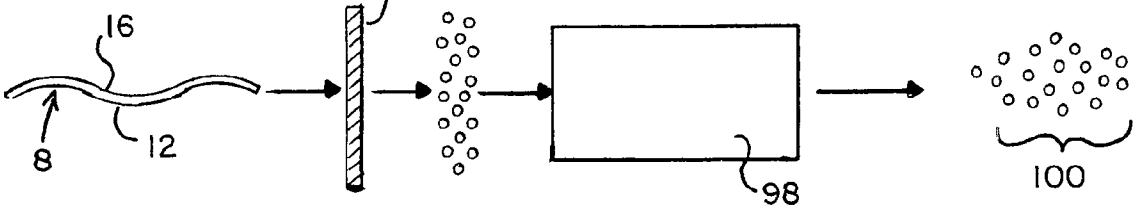
FIG. 11 is a schematic showing the process for recycling a body support structure.

Referring to FIG. 11, at the end of life of the body support structure, the entire structure, including the fabric 16 and grid structure 12, may be melted together in a furnace 98 due to the similar chemical make-up thereof. The body support structure may be shredded or ground up by a shredder/grinder 202 prior to melting. After melting, the combined melted material is collected, for example by extruding pellets 100 of the melted material. The collected material, e.g. the pellets, may then be used to manufacture other components, for example by melting the pellets and using them in a molding process.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support structure comprising:

a molded polymeric support grid having a three-dimensional molded contour, said polymeric support grid comprising a body support region having a plurality of through openings separated by a plurality of lands, wherein said polymeric support grid defines a first outermost layer having a first visible, outermost surface, wherein said polymeric support grid has an outer peripheral edge defining said body support region of said polymeric support grid, wherein said body support region has an overall area, and wherein a ratio of a surface area of said lands relative to said overall area of said body support region is less than or equal to 0.74; and a fabric layer bonded directly to said plurality of lands and covering said plurality of openings, wherein said fabric layer maintains a shape of said through openings when said body support structure is loaded and wherein said fabric layer defines a second outermost layer having a second visible, outermost surface opposite said first visible, outermost surface, wherein said support grid and said fabric layer are self-supporting.

2. The body support structure of claim 1 wherein a width of each of at least one pair of said openings is greater than a width of said land disposed between said openings of said pair.

3. The body support structure of claim 1 wherein said polymeric support grid and said fabric layer are made of the same polymeric material.

4. The body support structure of claim 3 wherein said polymeric material is polypropylene.

5. The body support structure of claim 1 wherein the body support region includes at least a thoracic region of a backrest.

6. The body support structure of claim 1 wherein at least some of said openings have a span of greater or equal to 8 mm and less than or equal to 25 mm.

7. The body support structure of claim 1 wherein said ratio is less than or equal to 0.70.

8. The body support structure of claim 7 wherein said ratio is less than or equal to 0.65.

9. The body support structure of claim 1 wherein said body support region defines a backrest.

10. The body support structure of claim 9 wherein at least one of said plurality of openings is elongated and extends continuously from a thoracic region to a sacral region of said backrest.

11. The body support structure of claim 1 wherein said body support region defines a seat.

12. The body support structure of claim 1 wherein said polymeric support grid and said fabric layer have outer peripheral edges, and further comprising an edge detail covering said peripheral edges, wherein said edge detail defines outermost first and second exposed surfaces overlying respectively portions of said first and second outermost surfaces of said polymeric support grid and said fabric layer.

13. The body support structure of claim 12 wherein said edge detail is molded around said peripheral edges.

14. A body support structure comprising:

a molded polymeric support grid having a three-dimensional molded contour, said support grid comprising a body support region having a plurality of through openings separated by a plurality of lands, wherein said polymeric support grid is defined by an outer peripheral edge, and wherein a ratio of a surface area of said plurality of lands relative to an overall area of said support grid is less than or equal to 0.70, and wherein at least one of said openings has a span of greater or equal to 8 mm and less than or equal to 25 mm, wherein said support grid defines a first outermost layer having a first visible, outermost surface; and a fabric layer directly bonded to said plurality of lands and covering said plurality of openings, wherein said fabric layer maintains a shape of said through openings when said body support structure is loaded and wherein said fabric layer defines second outermost layer having a second visible, outermost surface opposite said first visible, outermost surface, wherein said support grid and said fabric layer are self-supporting.

15. The body support structure of claim 14 wherein said polymeric support grid and said fabric layer are chemically miscible.

16. The body support structure of claim 15 wherein said polymeric support grid and said fabric layer are made of the same material.

17. The body support structure of claim 16 wherein said polymeric material is polypropylene.

18. The body support structure of claim 14 wherein said polymeric support grid and said fabric layer have outer peripheral edges, and further comprising an edge detail covering said peripheral edges, wherein said edge detail defines outermost first and second exposed surfaces overlying respectively portions of said first and second outermost surfaces of said polymeric support grid and said fabric layer.

19. The body support structure of claim 18 wherein said edge detail is molded around said peripheral edges.

20. A method of manufacturing a body support structure comprising:

molding a support grid in a three dimensional shape from a polymeric material, wherein said support grid comprises a body support region having a plurality of through openings separated by a plurality of lands, and wherein said support grid defines a first outermost layer having a first visible, outermost surface, wherein said support grid has an outer peripheral edge defining said body support region of said support grid, wherein said body support region has an overall area, and wherein a ratio of a surface area of said lands relative to said overall area of said body support region is less than or equal to 0.74;

melting only a surface layer of said support grid while maintaining a solid substrate adjacent said molten surface layer; and pressing a fabric directly against said molten surface layer of said plurality of lands of said support grid, wherein said fabric layer covers said plurality of through openings, wherein said fabric layer maintains a shape of said through openings when said body support structure is loaded and wherein said fabric layer defines a second outermost layer having a second visible, outermost surface opposite said first visible, outermost surface, wherein said support grid and said fabric layer are self-supporting.

21. The method of claim 20 wherein said melting said surface layer of said support grid comprises exposing said surface to an infrared emitter for a predetermined time period.

22. The method of claim 20 wherein said pressing said fabric against said molten surface layer comprises pressing a fluid bladder against said fabric.

23. The method of claim 20 further comprising trimming an edge of said fabric.

24. The method of claim 23 further comprising overmolding a trim edge onto said support grid and thereby covering said trimmed edge of said fabric.

25. The method of claim 20 wherein said support grid and said fabric are chemically miscible.

26. The method of claim 20 wherein said polymeric material is polypropylene.

27. The method of claim 20 wherein said support grid and said fabric are different colors.

28. A method of manufacturing a body support structure comprising:

molding a support grid in a three dimensional shape from a polymeric material, wherein said support grid comprises a body support region having a plurality of through openings separated by a plurality of lands, wherein said support grid defines a first outermost layer having a first visible, outermost surface, wherein said support grid has an outer peripheral edge defining said body support region of said support grid, wherein said body support region has an overall area, and wherein a ratio of a surface area of said lands relative to said overall area of said body support region is less than or equal to 0.74;

heating a surface of said support grid opposite said first outermost surface;

applying an adhesive to said heated surface of said support grid;

melting said adhesive; and pressing a fabric directly against said molten surface layer of said plurality of lands of said support grid, wherein said fabric layer covers said plurality of through openings, wherein said fabric layer maintains a shape of said through openings when said body support structure is loaded and wherein said fabric layer defines a second outermost layer having a second visible, outermost surface opposite said first visible, outermost surface, wherein said support grid and said fabric layer are self-supporting.

29. The method of claim 28 wherein said melting said adhesive comprises exposing said adhesive to an infrared emitter for a predetermined time period.

30. The method of claim 28 wherein said melting said adhesive and said pressing said fabric are performed simultaneously by conducting heat through said fabric to said adhesive.

31. The method of claim 30 wherein said pressing said against said molten surface layer comprises pressing a heated bladder press against said fabric.

* * * * *